US008550842B1

(12) United States Patent
Gutiérrez et al.

(10) Patent No.: US 8,550,842 B1
(45) Date of Patent: Oct. 8, 2013

(54) CABLE CONNECTOR SYSTEMS AND METHODS INCLUDING SAME

(75) Inventors: Mario Gutiérrez, Apex, NC (US); Chien-An Chen, Holly Springs, NC (US); Brian Ayres, Cary, NC (US); Ladislaus Kehl, Unterhaching (DE)

(73) Assignees: Tyco Electronics Corporation, Berwyn, PA (US); Tyco Electronics Raychem GmbH, Ottobrunn (DE)

( * ) Notice: Subject to any disclaimer, the term of this patent is extended or adjusted under 35 U.S.C. 154(b) by 0 days.

(21) Appl. No.: 13/480,033

(22) Filed: May 24, 2012

(51) Int. Cl.
*H01R 13/52* (2006.01)

(52) U.S. Cl.
USPC ..... 439/521; 439/604; 439/936; 174/74 R; 174/93

(58) Field of Classification Search
USPC ..... 174/74 R, 77 R, 79, 84 R, 88 R, 90, 92, 174/93, 94 R; 439/604, 797, 936, 796, 519, 439/521
See application file for complete search history.

(56) References Cited

U.S. PATENT DOCUMENTS 3,770,871 A * 11/1973 Goodman ..... 174/11 R
4,262,167 A 4/1981 Bossard et al.
4,701,574 A * 10/1987 Shimirak et al. ..... 174/93
5,201,914 A 4/1993 Hollick
5,422,438 A * 6/1995 Lamome ..... 174/84 C
6,284,976 B1 * 9/2001 Pulido et al. ..... 174/77 R
7,952,020 B2 * 5/2011 Yamamoto et al. ..... 174/23 R
8,404,975 B2 * 3/2013 Chang ..... 174/102 R
2003/0127242 A1 7/2003 Pilling et al.
2013/0056268 A1 * 3/2013 Bumgarner ..... 174/94 R

OTHER PUBLICATIONS

"Aluminum Shearbolt Connector" Instruction Sheet 408-8990, Jul. 5, 2006 Rev D, Tyco Electronics Corporation (2 pages).
"HVS-T-1580E-S 15kV Class Trifurcating Transition Splice for 3/C PIL to 3 1/C Extruded Dielectric (Poly/EPR) Power Cables" Raychem PII 54917, Rev AJ, PCN 307937-000, Effective Date: Mar. 13, 2007 (18 pages).
"General Instructions for Installation of Straight Bolted Connector on Splices" UE-1.0.9, Oh & Ug Distribution System Standards, Date: Oct. 3, 2008 (1 page).

* cited by examiner

*Primary Examiner* — James Harvey
(74) *Attorney, Agent, or Firm* — Myers Bigel Sibley & Sajovec, PA

(57) ABSTRACT

A cable connector system includes an electrical cable (having a primary conductor and an insulation layer), a connector, a flow block member and a flowable sealant. The primary conductor of the cable extends into a conductor bore of the connector through a passage in the flow block member and is mechanically and electrically coupled to the connector. The flow block member is thereby mounted on the primary conductor and interposed between a terminal end of the insulation layer and an end face of the connector. The sealant surrounds the flow block member and adjacent portions of the insulation layer and the connector. The flow block member inhibits flow of the sealant into the conductor bore through the entry opening.

23 Claims, 18 Drawing Sheets

CABLE CONNECTOR SYSTEMS AND METHODS INCLUDING SAME

FIELD OF THE INVENTION

The present invention relates to electrical cables and, more particularly, to connections and covers for electrical transmission cables.

BACKGROUND OF THE INVENTION

Covers are commonly employed to protect or shield electrical power cables and connections (e.g., low voltage cables up to about 1000V and medium voltage cables up to about 65 kV). Mastic is commonly used to provide electrical stress relief in areas proximate connectors that might otherwise present voids or other undesirable irregularities.

One application for such covers is for splice connections of metal-sheathed, paper-insulated cables such as paper-insulated lead cable (PILC). A PILC typically includes at least one conductor surrounded by an oil-impregnated paper insulation layer, and a lead sheath surrounding the conductor and insulation layer. Alternatively, the metal sheath may be formed of aluminum. In some cases, it is necessary to contain the oil. It is known to use a heat shrinkable sleeve made of a polymer that does not swell when exposed to the oil. Examples of such heat shrinkable sleeves include heat shrinkable oil barrier tubes (OBT) available from TE Connectivity. The sleeve is placed over the oil impregnated paper and heat is applied to contract the sleeve about the insulation layer. Mastic or other sealant material may be used at each end of the sleeve to ensure an adequate seal and containment of the oil.

SUMMARY OF THE INVENTION

According to embodiments of the present invention, a cable connector system includes an electrical cable, a connector, a flow block member and a flowable sealant. The electrical cable includes a primary conductor and an insulation layer surrounding the primary conductor. The insulation layer has an insulation terminal end and the primary conductor extends beyond the insulation terminal end. The connector defines a conductor bore, an entry opening communicating with the conductor bore, and a connector end face surrounding the entry opening. The flow block member defines a passage extending therethrough. The primary conductor extends through the passage and the entry opening and into the conductor bore. The primary conductor is mechanically and electrically coupled to the connector. The flow block member is thereby mounted on the primary conductor and interposed between the insulation terminal end and the connector end face. The sealant surrounds the flow block member and adjacent portions of the insulation layer and the connector. The flow block member inhibits flow of the sealant into the conductor bore through the entry opening.

According to method embodiments of the present invention, a method for forming a protected electrical connection assembly includes: providing an electrical cable including a primary conductor and an insulation layer surrounding the primary conductor, wherein the insulation layer has an insulation terminal end and the primary conductor extends beyond the insulation terminal end; providing a connector defining a conductor bore, an entry opening communicating with the conductor bore, and a connector end face surrounding the entry opening; providing a flow block member defining a passage extending therethrough; inserting the primary conductor through the passage and the entry opening and into the conductor bore such that the flow block member is thereby mounted on the primary conductor and interposed between the insulation terminal end and the connector end face; mechanically and electrically coupling the primary conductor to the connector; and applying a sealant to surround the flow block member and adjacent portions of the insulation layer and the connector, wherein the flow block member inhibits flow of the sealant into the conductor bore through the entry opening.

According to embodiments of the present invention, a cable connector system kit for use with an electrical cable including a primary conductor and an insulation layer surrounding the primary conductor, wherein the insulation layer has an insulation terminal end and the primary conductor extends beyond the insulation terminal end, includes a connector, a flow block member and a flowable sealant. The connector defines a conductor bore, an entry opening communicating with the conductor bore, and a connector end face surrounding the entry opening. The connector is adapted to mechanically and electrically couple with the primary conductor. The flow block member defines a passage extending therethrough and adapted to receive the primary conductor. The flowable sealant can be applied about the connector and the insulation layer. The connector and the flow block member are relatively configured and constructed to be assembled into a connector system wherein: the primary conductor extends through the passage and the entry opening and into the conductor bore, the primary conductor being mechanically and electrically coupled to the connector; the flow block member is thereby mounted on the primary conductor and interposed between the insulation terminal end and the connector end face; the sealant surrounds the flow block member and adjacent portions of the insulation layer and the connector; and the flow block member inhibits flow of the sealant into the conductor bore through the entry opening.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE INVENTION

Figure 1:
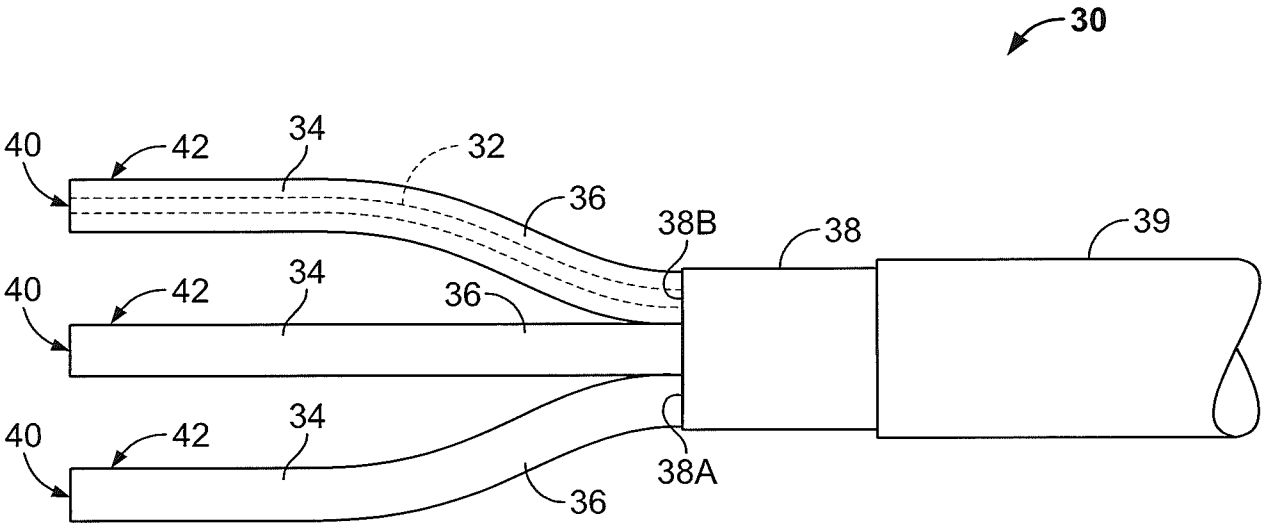
FIG. 1 is a side view of an exemplary PILC cable.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90° or at other orientations) and the spatially relative descriptors used herein interpreted accordingly.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

As used herein, "monolithic" means an object that is a single, unitary piece formed or composed of a material without joints or seams.

Figure 11:
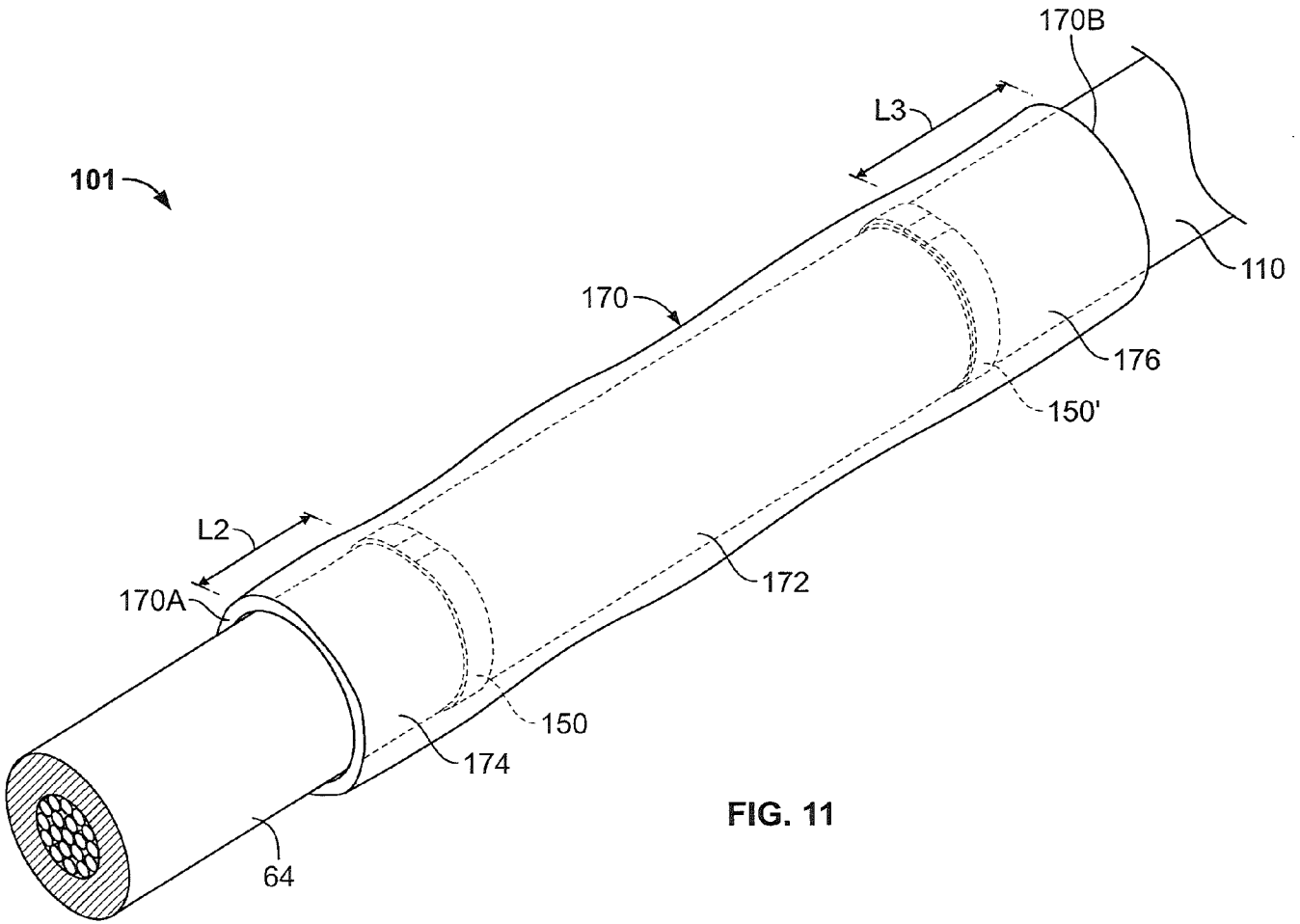
Figure 15:
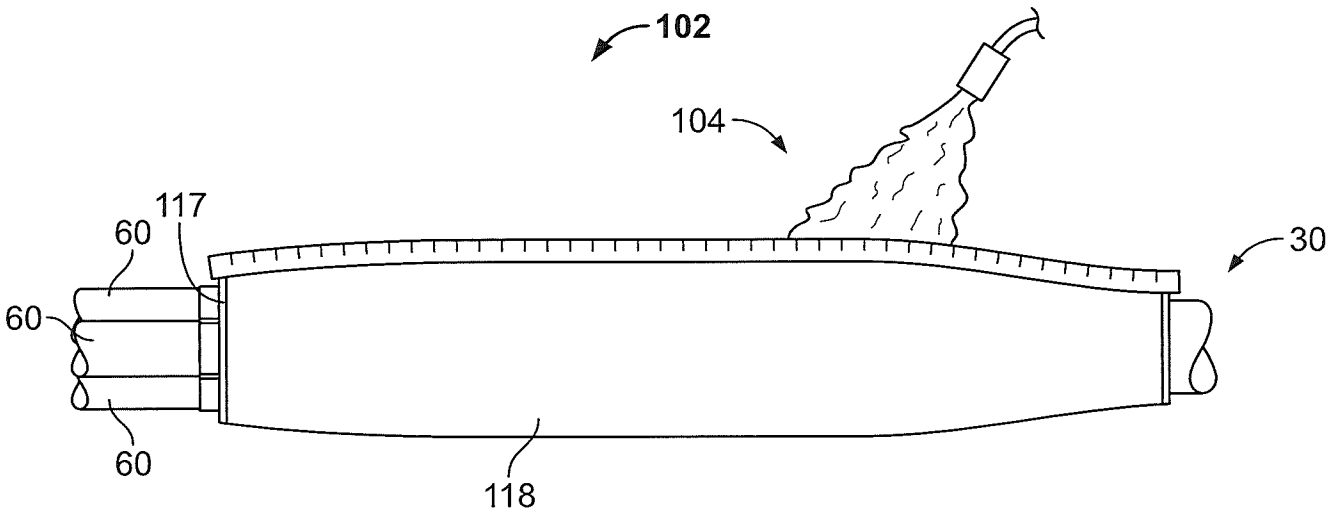
FIG. 15 is side view of the connection assembly of FIG. 14 having a re-jacketing sleeve mounted thereon.

With reference to FIG. 11, a cable connector system 101 according to some embodiments of the present invention is shown therein. The connector system 101 can be used in combination with additional components to form a cover system 104 (FIG. 15). The cover system 104 may in turn be used to form a protected connection assembly 102 including two or more connected cables, as shown in FIG. 15. In some embodiments, the connector system 101 is provided as a pre-packaged kit of components for subsequent assembly by an installer (e.g., a field installer) using a method as described herein.

The connector system 101 can be used to electrically and mechanically couple or splice a pair of electrical power transmission cables. The spliced cables may include polymeric insulated cables, paper-insulated lead cables (PILC), or one of each. In the embodiment illustrated in FIGS. 1-15 and described hereinbelow, the connector system 101 is used to couple (i.e., provide a transition joint between) an oil-containing cable (PILC) 30 and a polymeric cable 60. However, it will be appreciated that other combinations of conductors may be joined in accordance with embodiments of the invention.

The cable 30 (FIG. 1) as illustrated is a three-phase cable including three electrical conductors 32, which may be formed of any suitable material such as copper, and may be solid or stranded. Each conductor 32 is surrounded by a respective oil-impregnated paper insulation layer 34. The oil impregnating each layer 34 may be any suitable oil such as a mineral oil. A respective metal screen 36 may surround each paper layer 34. A metal sheath 38 surrounds the three conductors 32, collectively. According to some embodiments, the metal sheath 38 is a lead sheath and the cable 30 may be commonly referred to as a paper-insulated lead cable (PILC).

According to other embodiments, the metal sheath 38 is formed of aluminum. A polymeric jacket 39 surrounds the metal sheath 38.

Figure 2:
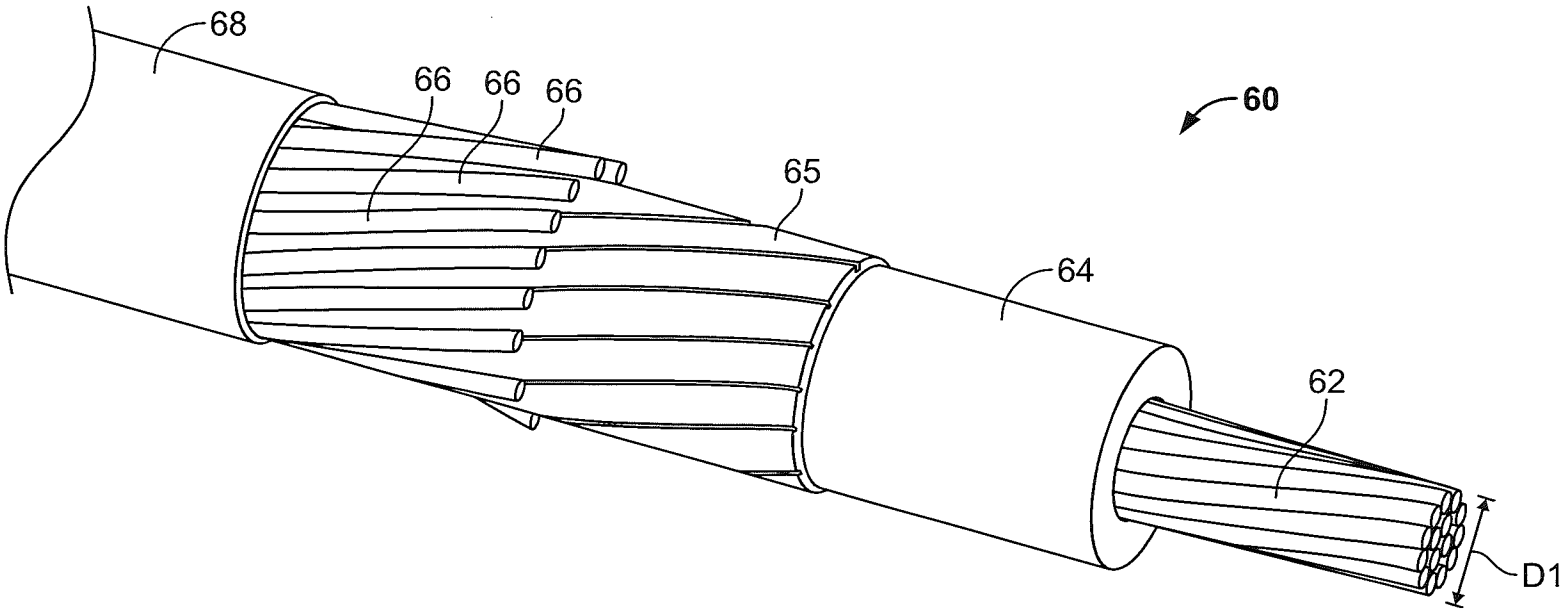
FIG. 2 is a perspective view of an exemplary polymeric cable.
Figure 3:
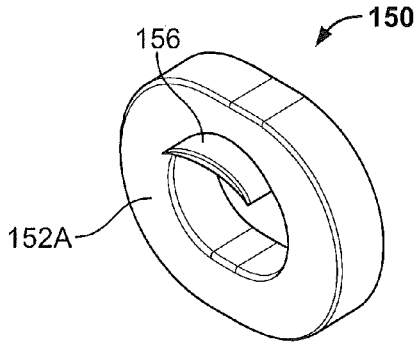
FIG. 3 is a front perspective view of a flow block member forming a part of a connector system according to embodiments of the present invention.
Figure 4:
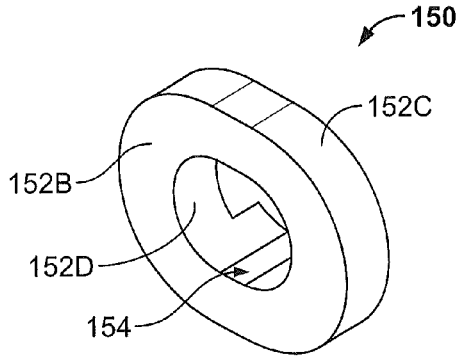
FIG. 4 is a rear perspective view of the flow block member of FIG. 3.
Figure 5:
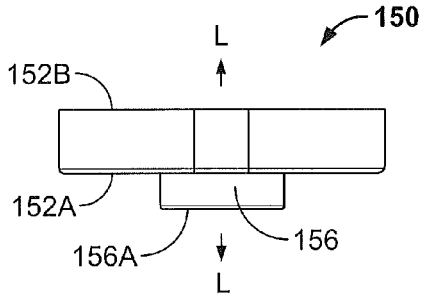
FIG. 5 is a top view of the flow block member of FIG. 3.
Figure 6:
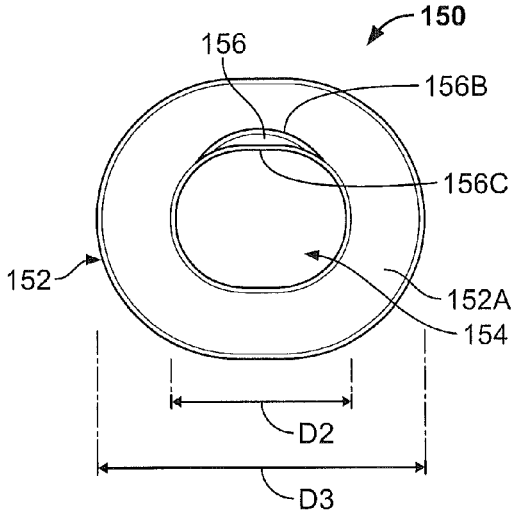
FIG. 6 is a front plan view of the flow block member of FIG. 3.
Figure 7:
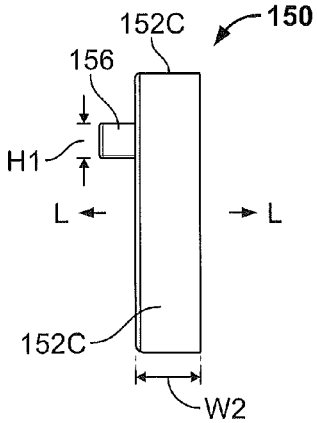
FIG. 7 is a side view of the flow block member of FIG. 3.

In the illustrated embodiment, the three conductors 32 of the cable 30 are each spliced to a respective one of three polymeric cables 60. As shown in FIG. 2, each polymeric cable 60 includes a primary electrical conductor 62, a polymeric conductor insulation layer 64, a semiconductive layer 65, one or more neutral conductors 66, and a jacket 68, with each component being concentrically surrounded by the next. According to some embodiments and as shown, the neutral conductors 66 are individual wires, which may be helically wound about the semiconductive layer 65. The primary conductor 62 may be formed of any suitable electrically conductive materials such as copper (solid or stranded). The polymeric insulation layer 64 may be formed of any suitable electrically insulative material such as crosslinked polyethylene (XLPE) or EPR. The semiconductive layer 65 may be formed of any suitable semiconductor material such as carbon black with silicone. The neutral conductors 66 may be formed of any suitable material such as copper. The jacket 68 may be formed of any suitable material such as EPDM.

However, it will be appreciated that polymeric cables of other types and configurations may be used with the connector system 101. For example, the polymeric cable may include three conductors, each surrounded by a respective polymeric insulation and a respective semiconductive elastomer, and having a metal shield layer collectively surrounding the three conductors and a polymeric jacket surrounding the shield layer.

Figure 12:
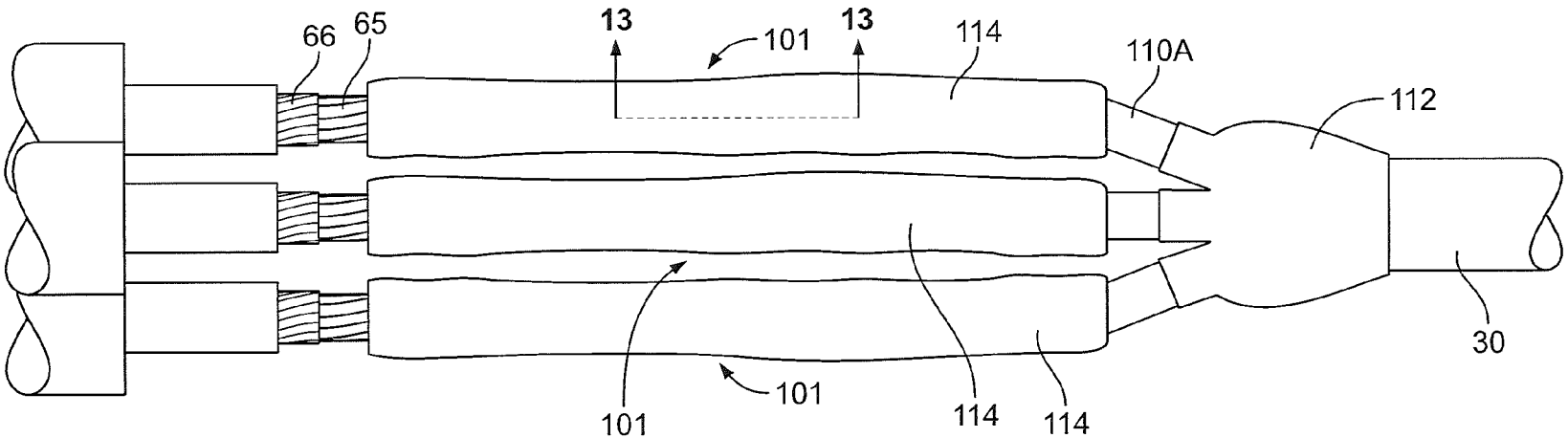

In the illustrated embodiment, three connector systems 101 are employed (one for each phase), as shown in FIG. 12. The three connector systems 101 may be constructed in the same or similar manner and therefore only one of the connector systems will be described in detail hereinbelow, and this description will likewise apply to the other connector systems. However, the connector systems 101 employed to splice a group of cables need not be identical.

The connector system 101 includes a mechanical and electrical connector 130 (FIG. 9), a pair of grommets, dam members or flow block members 150, 150' (FIG. 9), and a mass of a flowable sealant material 170 (FIG. 11). According some embodiments and as described hereinbelow, the flowable sealant material 170 is a mastic.

According to some embodiments and as shown, the connector 130 (FIGS. 9 and 13) is a shear bolt connector 130. The shear bolt connector 130 includes an electrically conductive (e.g., metal) connector body 132 and a plurality of shear bolts 144. The connector 130 may also include one or a pair of spacer inserts 149. The connector body 132 has opposed ends 132A, 132B. The connector body 132 has an intermediate or central oil stop wall 134 and a tubular sidewall 135. The inner surface 135A of the sidewall 135 and the oil stop wall 134 define opposed conductor cavities or bores 136A, 136B on either side of the wall 134, as well as opposed entry openings 138A and 138B on each end 132A, 132B communicating with the bores 136A and 136B, respectively. An annular end face 140A on the end 136A surrounds the entry opening 138A. An annular end face 140B on the end 136B surrounds the entry opening 138B. Threaded bolt bores 142 are defined in the sidewall 135 of the connector body 132.

Each bolt 144 includes a shank 146 and a head 148. The head 148 may be configured to operably engage a driver to be forcibly driven by the driver. The shank 146 includes a threaded section 146A configured to threadedly engage an associated one of the bolt bores 142. The shank 146 also includes a breakaway section 146B between the threaded section 146A and the head 148. Each bolt 144 is adapted to be screwed down into its respective bolt bore 142 to clamp a conductor 32, 62 in the underlying conductor bore 136A or 136B. The head 148 on the bolt 144 is configured to shear off of the threaded shank 146A at the breakaway section 146B when subjected to a prescribed torque. According to some embodiments, the bolt 144 is formed of copper or aluminum.

Figure 13:
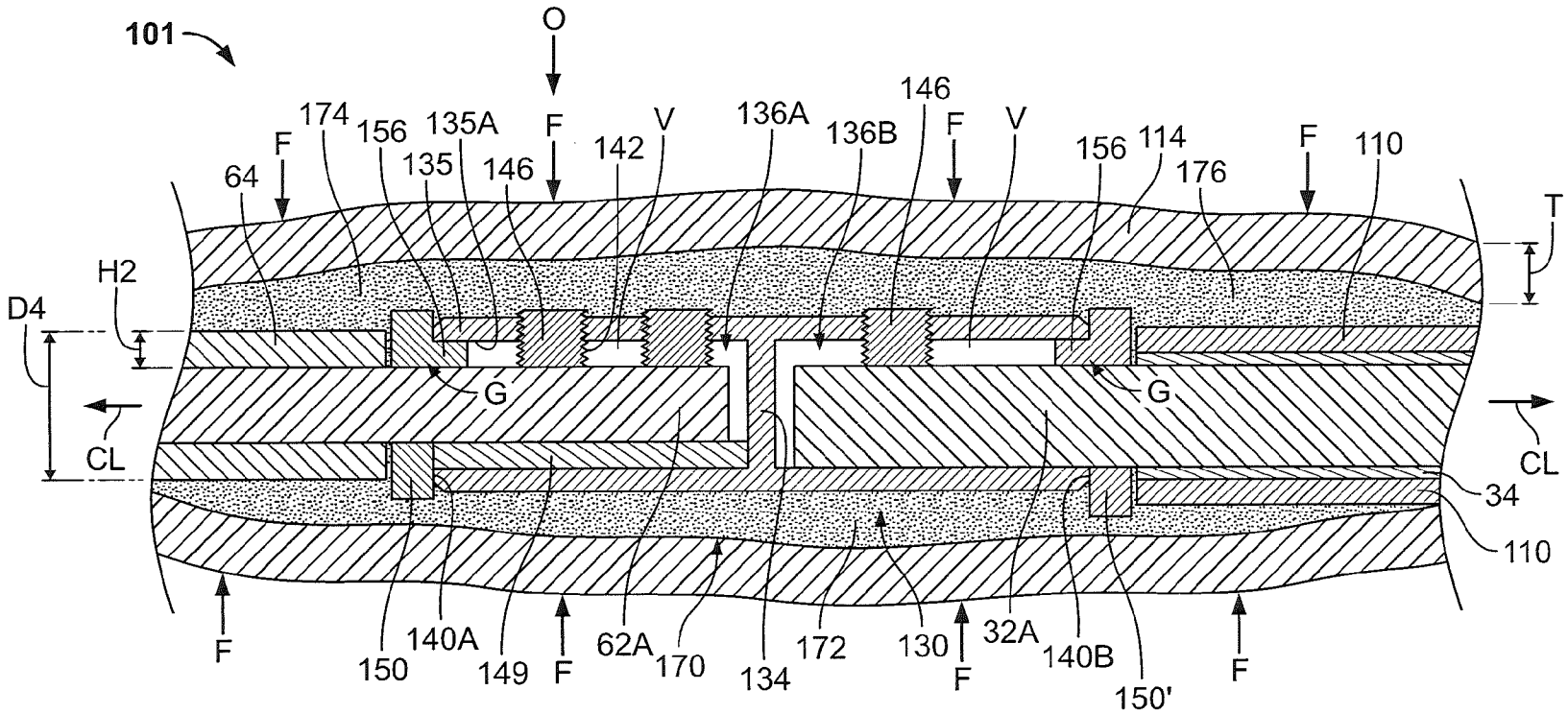
FIG. 13 is a cross-sectional view of the connection assembly of FIG. 12 taken along the line 13-13 of FIG. 12.

The spacer inserts 149 are each optionally positioned in a respective one of the bores 136A, 136B. In FIG. 13, a spacer insert 149 is shown installed in the conductor bore 136A while no spacer insert 149 is provided in the conductor bore 136B. The connector 130 may be supplied to the installer with the spacer inserts 149 mounted in the bores 136A, 136B, whereupon the installer can selectively remove one or both of the spacer inserts 149 to customize the connector 130 to the cable conductors to be secured in the bores 136A, 136B. In this way, the range of cable conductors that can be effectively accommodated by a given connector 130 is increased.

The flow block members 150, 150' may be constructed and configured in the same manner. Accordingly, the description of the flow block member 150 below may likewise apply to the flow block member 150'. However, the flow block members 150, 150' need not be identical.

With reference to FIGS. 3-7, the flow block member 150 includes a body 152. The body 152 has a front face 152A, an opposing rear face 152B, an outer surface 152C, and an inner surface 152D. The faces 152A, 152B are substantially planar. The inner surface 152D defines a through passage 154 so that the body 152 takes the form of an annular body or endless ring having a longitudinal axis L-L. An integral insert tab 156 extends forwardly from the front face 152A to a terminal end 156A. The insert tab 156 may have an inner surface 156C that is substantially coextensive with and substantially matches a segment of the profile of periphery of the passage 154. The insert tab 156 may have an outer surface 156B that substantially matches the profile of a segment of the periphery of the opening 138A of the connector 130 (i.e., the inner wall surface 135A).

The flow block member 150 may be formed of any suitable material. According to some embodiments, the flow block member 150 is formed of a resiliently deformable material. According to some embodiments, the flow block member 150 is formed of an elastomeric material. According to some embodiments, the flow block member 150 is formed of silicone rubber. Other suitable elastomeric materials may include ethylene-propylene-diene-monomer (EPDM) rubber, butyl rubber or nitrile rubber. However, silicone rubber may be particularly advantageous because silicone rubber is stable over a wide service temperature range, is highly resistant to oil absorption, and will not degrade when subjected to oil.

According to some embodiments, the flow block member 150 has a Young's Modulus of in the range of from about 1 to 20 MPa and, in some embodiments, from about 1 to 5 MPa.

According to some embodiments, the flow block member 150 has a Shore A hardness in the range of from about 10 to 90.

The flow block member 150 may be formed using any suitable technique. According to some embodiments, the flow block member 150 is molded or extruded and, according to some embodiments, injection molded. Alternatively, the flow block member 150 may be stamped. According to some embodiments, the flow block member 150 is monolithic and the body 152 and tab 156 are unitarily molded or otherwise formed such that they form a unitary structure.

According to some embodiments, the flow block member 150 is formed of a closed cell polymeric foam. According to some embodiments, the closed cell foam is an oil-resistant base polymer such as silicone. In some embodiments, the elasticity/compressibility of the closed cell foam is in the range of from about 20 to 70 percent to accommodate a wide application range. In some embodiments, the individual cells of the foam have a size or sizes in the range of from about 0.5 to 1 mm. In some embodiments, the exposed surfaces of the flow block member 150 are smooth and may be substantially non-porous. In other embodiments, at least some of the exposed surfaces are rough or have exposed open cells (e.g., as obtained from cutting a foam block, bar or tube into pieces). According to some embodiments, the polymer foam has a low tension set and high application temperature. According to some embodiments, the closed cell foam flow block members are extruded and cut or sliced into substantially flat rings, which form the body of the flow block member.

The mastic 170 (FIGS. 11 and 13) is a sealing material that is flowable within its intended service temperatures. According to some embodiments, the intended service temperatures are in the range of from about −40° C. to 140° C. According to some embodiments, the mastic 170 has a viscosity in the range of from about 50 to 100 mooney units at 100° C.

The mastic 170 may be any suitable sealing mastic. According to some embodiments, the mastic 170 is resistant to chemical attack from oil, and resistant to migration of oil therethrough. According to some embodiments, the mastic 170 is formed of nitrile rubber, epichlorhydrin rubber, or fluorinated rubber.

The cover system 104 may further include three tubular oil barrier tubes (OBTs) 110 (FIG. 8), a PILC breakout 112 (FIG. 8), three electrical stress control tubes 114 (FIGS. 12 and 13), three heat shrinkable tubes 116 (FIG. 14), a polymeric cable breakout 117 (FIG. 15), and are jacketing sleeve 118 (FIG. 15). The cover system 104 may also include shielding material (e.g., mesh or tape), sealants (e.g., mastic), tapes, spacer (s), ground conductors, and/or other components as appropriate to effect the desired electrical and mechanical joint.

Each OBT 110 (FIG. 8) may be formed of any suitable material. According to some embodiments, each OBT 110 is formed of an electrically insulative material and may include an electrically conductive semiconductive layer 110A (which may be integrally formed with the OBT 110 or a separate tube mounted thereover). According to some embodiments, each OBT 110 is formed of an elastically expandable material, which may be an elastomeric material. Suitable materials for the OBTs may include EPDM, neoprene, butyl or polyurethane. Each OBT 110 may be initially mounted on a holdout (not shown).

The breakout 112 (FIG. 8) may include a main tubular body 112A and three circumferentially distributed tubular fingers 112B integral with the main body. The breakout 112 may be formed of any suitable material. According to some embodiments, the breakout 112 is formed of an electrically insulative material. According to some embodiments, the breakout 112 is formed of an elastically expandable material such as an elastomeric material. Suitable materials may include EPDM, neoprene, butyl, polyurethane, silicone or fluorosilicone.

The stress control tubes 114 (FIGS. 12 and 13) may be of any suitable construction and materials. The elastomeric stress control tubes 114 may include a tubular elastomeric, electrically insulative layer and one or more internal electrically semiconductive layers, for example, as known in the art for controlling electrical stresses, providing electrical shielding and bridging the electrically semi-conductive layers of the cables. Suitable materials for the stress control tubes 114 may include silicone rubber, for example.

The three heat shrinkable tubes 116 (FIG. 14) may be of any suitable construction and materials. Suitable materials for the tubes 116 may include polyolefin or elastomeric materials, for example.

The breakout 117 (FIGS. 8 and 15) includes a main tubular body and three circumferentially distributed tubular fingers integral with the main body. The breakout 117 may be formed of any suitable material. According to some embodiments, the breakout 117 is formed of an electrically insulative material. According to some embodiments, the breakout 117 is formed of an elastically expandable material such as an elastomeric material. Suitable materials may include EPDM, neoprene, butyl, polyurethane, silicone or fluorosilicone.

The re-jacketing sleeve 118 (FIG. 15) may be of any suitable construction and materials. Suitable materials for the re-jacketing sleeve 118 may include polyethylene, thermoplastic elastomer (TPE), or silicone rubber, for example. Suitable re-jacketing sleeves may include a heat shrinkable re-jacket (as shown) or the GMRS Rejacketing Sleeve available from TE Connectivity, for example.

The constructions of the connector system 101 and the cover assembly 102 may be further appreciated in view of methods for forming the connection assembly 104 (FIG. 15) according to embodiments of the present invention, as discussed in further detail below. However, it will be appreciated that certain of the steps and components disclosed hereinbelow may be altered or omitted in accordance with further embodiments of the invention.

With reference to FIG. 1, the cable 30 is prepared by progressively trimming back or removing end sections of the jacket 39, the metal sheath 38, and the metal screen 36 as shown. The paper insulation 34 of each conductor 32 may also be trimmed back or may be subsequently trimmed prior to installing the connectors 50. Each conductor 32 and the paper insulation 34 surrounding the conductor 32 may be referred to herein as a cable core 40. The metal sheath 38 has a terminal edge 38A defining an end opening 38B through which extended sections 42 of the three cable cores 40 extend. The paper insulation 34 of each cable core 40 is trimmed back as shown in FIG. 8 to expose a terminal or engagement section 32A of the conductor 32.

Figure 8:
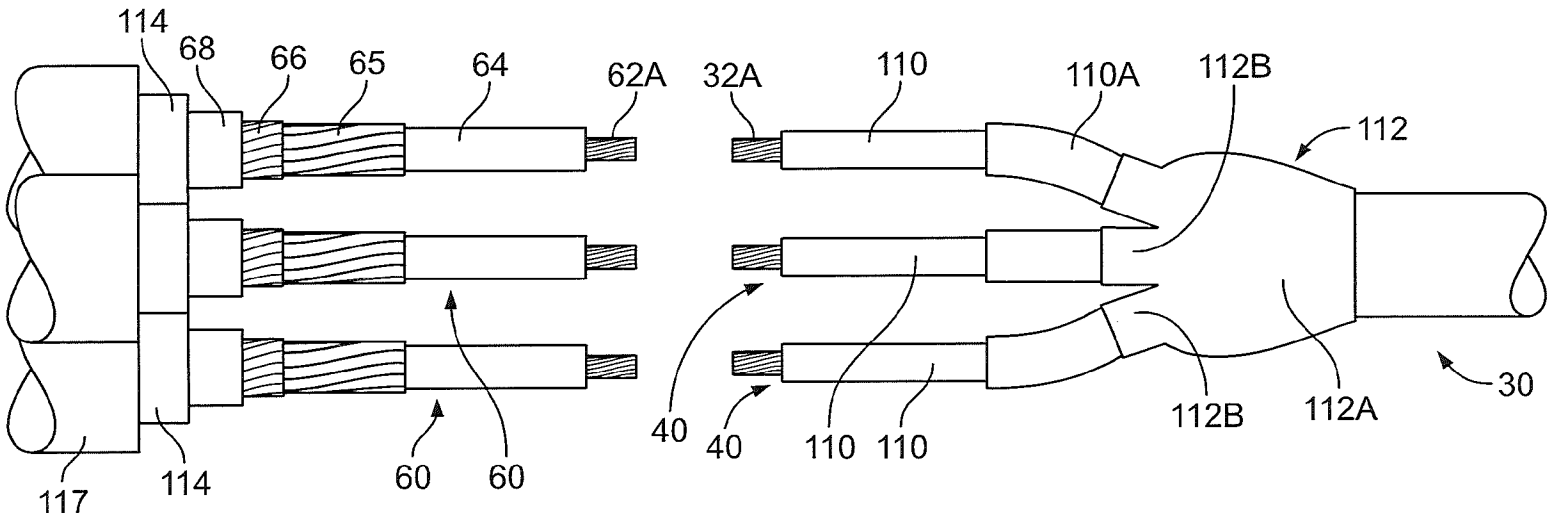
FIGS. 8-12 illustrate methods for forming a connection assembly according to embodiments of the present invention using a connector system according to embodiments of the present invention.

As shown in FIG. 8, an OBT 110 is mounted on each cable core 40 and the breakout 112 is mounted over the OBTs 110.

Each cable 60 is prepared by cutting each layer 62, 64, 65, 66 and 68 such that a segment of each layer 62, 64, 65 and 66 extends beyond the next overlying layer 64, 65, 66 and 68 as shown in FIG. 8. A terminal or engagement section 62A of the conductor 62 extends outwardly beyond the insulation 64.

The following procedure can be executed for each of the cable core 40/polymeric cable 60 pairs in turn.

In the exemplary connection, the size (outer diameter) of the conductor 32 is in a range better accommodated by the full bore 136B, and therefore, the installer will not install a spacer insert 149 in or, if pre-installed, will remove the spacer insert 149 from the conductor bore 136B. Also, in the exemplary connection, the size (outer diameter) of the conductor 64 is in a range better accommodated by a conductor bore smaller in size than the full bore 136A, and therefore, the installer will install the spacer insert 149 in or, if pre-installed, will retain the spacer insert 149 in the conductor bore 136A.

Figure 9:
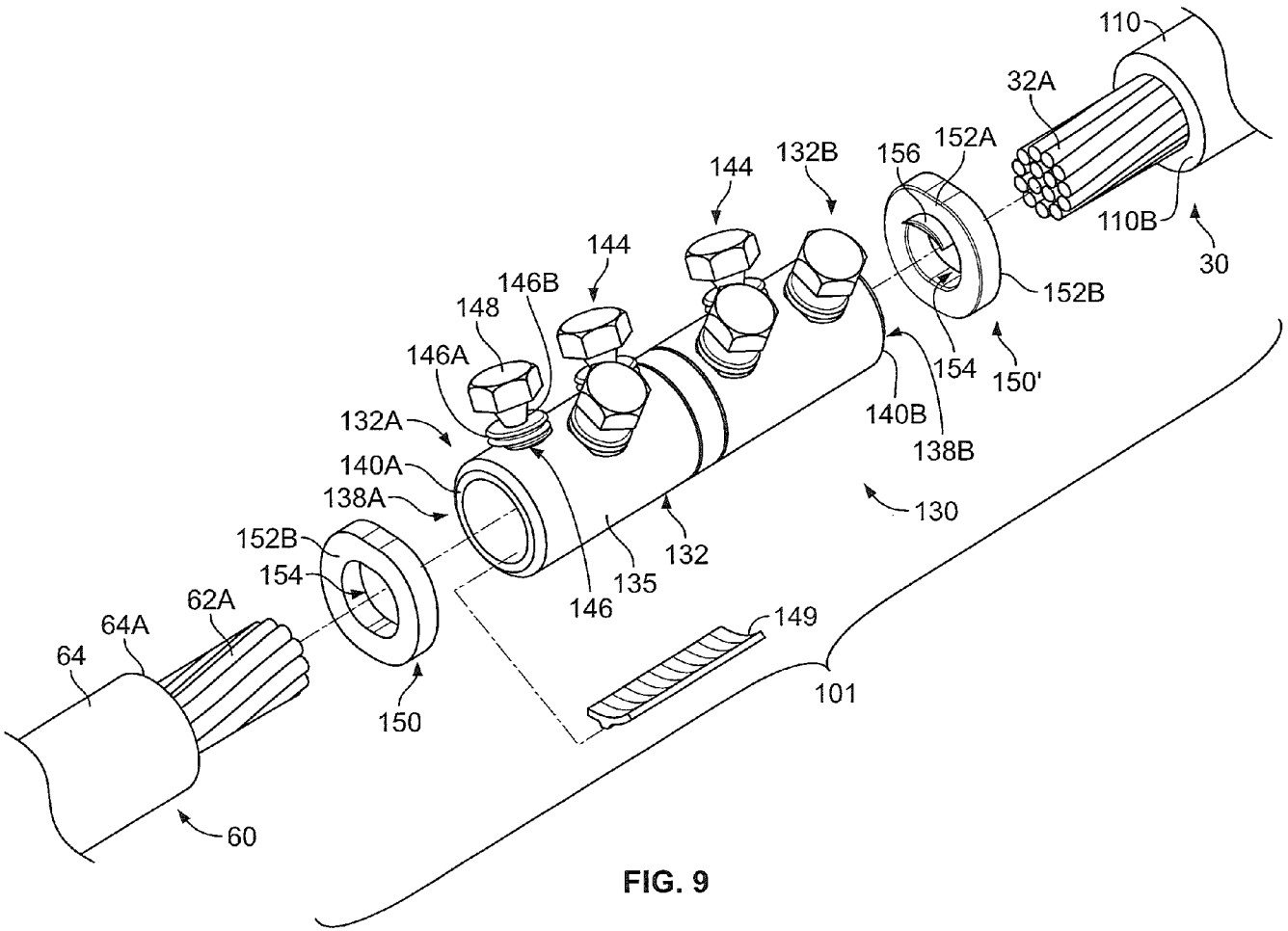
Figure 10:
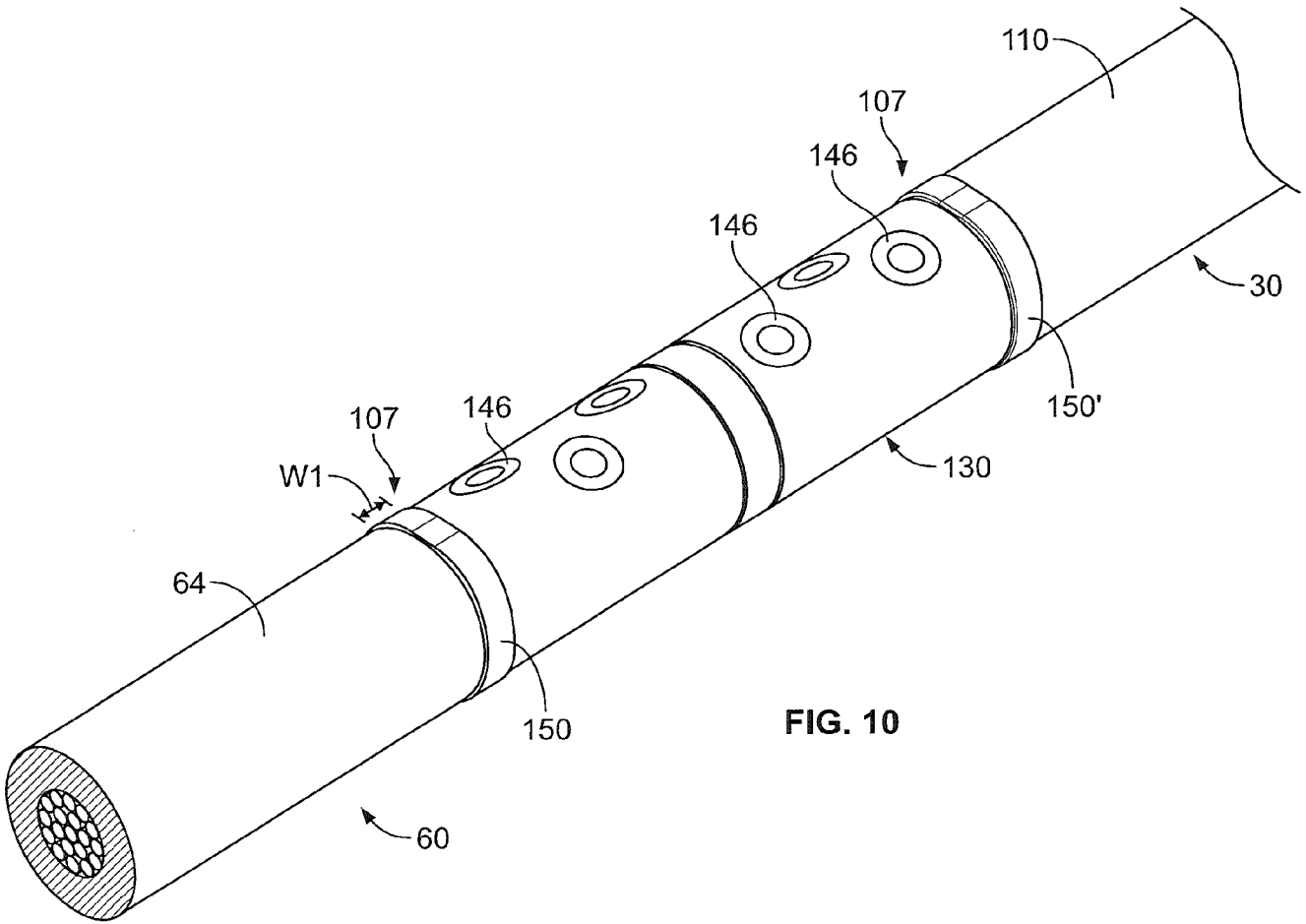

With reference to FIGS. 9, 10 and 13, the conductor 62 is inserted through the passage 154 and the flow block member 150 is mounted on the conductor 62 so that the rear face 152B is closely adjacent or in abutment with the terminal edge 62A or face of the polymeric insulation 64. The conductor 62 is then inserted into the bore 136A until the front face 152A of the flow block member 150 abuts the end face 140A of the connector 130. The insert tab 156 is inserted into the bore 136A (i.e., inboard of the connector end face 140A) in a space or void V located radially between the conductor 62 outer diameter and the inner surface 135A of the connector sidewall 135 on the side having the bolt bores 142. The insert tab 156 may thus tend to radially offset the conductor 62 relative to the centerline CL-CL of the connector bore 136A (i.e., in an offset direction O; FIG. 13).

The bolts 144 overlying the bore 136A are driven into the bore 136A via their heads 148 until sufficient torque is applied to shear the head 148 off at the breakaway section 146. The intruding bolts 144 may tend to forcibly radially displace the conductor 64 in the offset direction O with respect to the bore centerline CL-CL. At this time, the end segment of the conductor 62 is secured in the bore 136A by the remainder of each bolt 144, as shown in FIGS. 10 and 13. The relative axial positions of the insulation 64 and the end face 140A are thereby fixed to provide a gap width W1 (FIG. 10) therebetween. The flow block member 150 is captured between the insulation terminal edge 64A and the connector end face 140A. According to some embodiments, the flow block member 150 forms an annular seal between the front face 152A and the connector end face 140A.

According to some embodiments, the gap width W1 is the same as or less than the relaxed width W2 (FIG. 7) of the flow block member 150 so that the insulation terminal edge 64A and the connector end face 140A are each positively seated or axially loaded against the respective adjacent faces 152B and 152A of the flow block member 150. According to some embodiments, the gap width W1 is at least 50 percent less than the flow block member relaxed width W2.

According to some embodiments, the relaxed height H1 (FIG. 7) of the insert tab 156 is between about 25 and 69 percent of the height H2 (FIG. 13) of the gap between the conductor 62 and the portion of the wall inner surface 135A adjacent the opening 138A.

According to some embodiments, the relaxed inner diameter D2 (FIG. 6) of the flow block member 150 (i.e., the diameter of the passage 154) is the same as or less than the outer diameter D1 (FIG. 2) of the conductor 62 so that the inner surface 152D positively seats or is radially loaded against the outer diameter of the conductor 62. According to some embodiments, the relaxed inner diameter D2 is at least 25 percent less than the outer diameter D1. The elasticity of the flow block member 150 may permit the use of a flow block member 150 of a given size with cables 60 in a range of outer diameter sizes and may accommodate variations in the nominal outer diameter of the conductor 64.

According to some embodiments, the relaxed outer diameter D3 (FIG. 6) of the flow block member 150 is greater than the inner diameter D4 (FIG. 13) of the connector opening 138A so that the flow block member 150 radially overlaps the connector end face 140A continuously about the full circumference of the connector end face 140A. According to some embodiments, the relaxed outer diameter D3 is at least 125 percent greater than the inner diameter D4.

The cable core 40 is likewise coupled to the connector 130. In the same manner, the flow block member 150' is mounted on the conductor 32 and the conductor 32 is secured in the connector bore 136B by the corresponding shear bolts 144 to thereby capture the flow block member 150' between the terminal edge or face 110B of the OBT 110 and the connector end face 140B, as shown in FIGS. 10 and 13. The relationships between the various connection components may likewise be as described above with regard to the connection between the cable 60 and the connector 130.

The mastic 170 is then wrapped about the cable core 40, the flow block member 150', the connector 130, the flow block member 150 and the polymeric cable 60 as shown in FIG. 11. More particularly, a strip or strips of the mastic 170 can be wrapped or wound onto the cable core 40, the flow block member 150', the connector 130, the flow block member 150 and the polymeric cable 60 such that a portion 172 of the mastic 170 fully circumferentially surrounds the connector body 132, a portion 174 of the mastic 170 fully circumferentially surrounds the flow block member 150 and overlaps (circumferentially surrounding) the polymeric cable polymeric insulation 60, and a portion 176 of the mastic 170 fully circumferentially surrounds the flow block member 150' and overlaps (circumferentially surrounding) the OBT 110. The mastic 170 extends from a terminal end 170A to a terminal end 170B. According to some embodiments, the mastic 170 directly engages and adheres to the overlapped outer surfaces of the components 130, 150, 150', 30, 60.

According to some embodiments, the mastic 170 overlaps the insulation 64 by a distance L2 (FIG. 11) in the range of from about ¼ to ½ inch. According to some embodiments, the mastic 170 overlaps the OBT 110 by a distance L3 in the range of from about ¼ to ⅜ inch. According to some embodiments, the nominal thickness T (FIG. 13) of the mastic 170 in the region from the rear face 152B of the flow block member 150 to the rear face 152B of the flow block member 150' is in the range of from about 0.08 to 0.39 inch.

The stress control tube 114 is then mounted around the connector 130, the mastic 170 and adjacent portions of the cables 30, 60. The stress control tube 114 overlaps a portion of the semiconductive layer 65 on one end and a portion of the OBT semiconductive layer 110A on the other end.

Each of the other cable pairs can be connected and covered in the same manner as described above using respective connector systems 101. FIG. 12 shows the cable 30 with all three cable cores 40 having been connected to a respective associated polymeric cable 60 using a respective connector system 101 and covered with a respective stress control tube 114.

Figure 14:
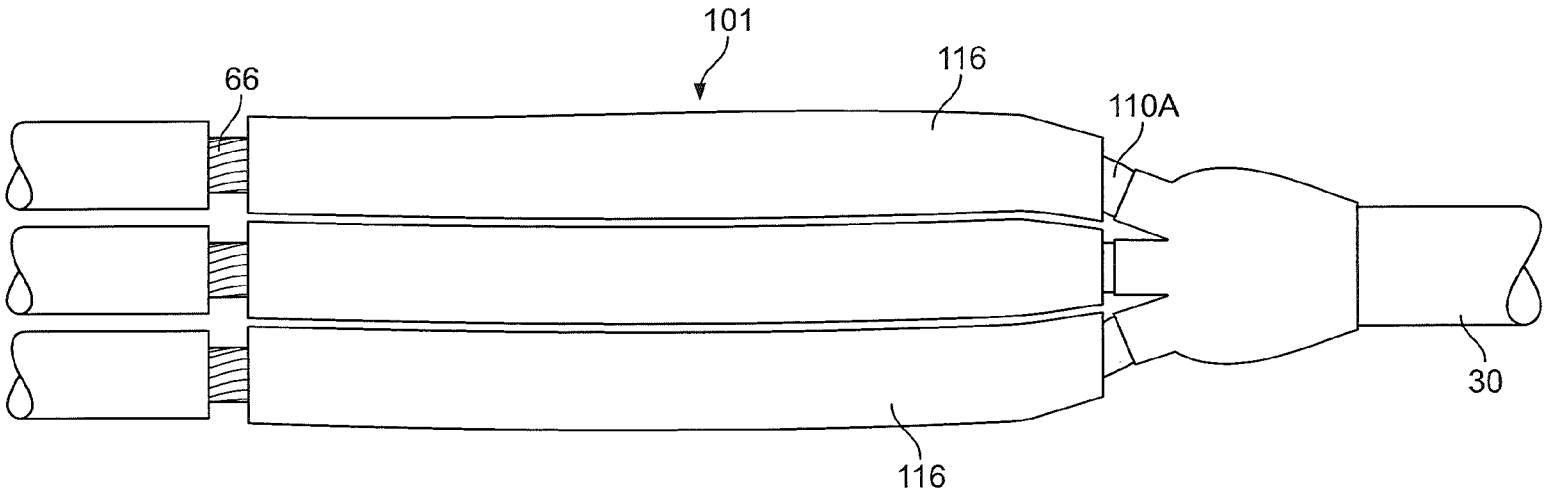
FIG. 14 is side view of the connection assembly of FIG. 12 having heat shrinkable tubes mounted thereon.

The heat shrinkable tubes 116 are then mounted around the connections such that they overlap the neutral conductors 66 on one end and a grounding conductor (not shown) on the other end, as shown in FIG. 14.

The assembly can thereafter be grounded, shielded and re-jacketed in known manner, for example. For example grounding braids can be connected to the shield layers 68 of the polymeric cables 60 and the metal sheath 30 by clamps or the like. The entire joint assembly can be covered by the re-jacketing sleeve 118 (FIG. 15), which overlaps the cable jacket 39 and the jackets 68.

The connector system 101 can provide significant advantages and overcome or mitigate problems commonly associated with similar connections of the known art. Because the inner diameter of the conductor bore 136A, 136B of the connector 130 is greater than the outer diameter of the received conductor 62, 32, a significant gap G will often be created between the conductor and the bore wall 135 at the opening 138A, 138B. In connector systems of the prior art, this gap presents a passage through which the mastic 170 at the joints between the insulation 64 or OBT 110 and the connector 130 can flow into the conductor bore 136A, 136B. Notably, this mastic 170 is relied upon to provide electrical stress relief at the joint 107. The unintended loss of the mastic 170 into the connector 130 can therefore risk failure or degradation of the splice due to electrical stresses.

Various environmental parameters may encourage or induce flow of the mastic 170 into the conductor bores. In service, environmental and electrical resistance heating of the connection and conductors heats the mastic 170, thereby softening and reducing the viscosity of the mastic 170. With reference to FIG. 13, the stress control tube 114 applies radially inward compressive forces F to the mastic 170 that tend to force the mastic 170 into the cable/connector joints and through the conductor/connector gap G. Thermal expansion of joint components may also tend to force flow of the mastic 170.

The connector system 101 according to embodiments of the present invention can prevent, limit or inhibit such unintended and undesirable flow, displacement or extrusion of the mastic 170 into the conductor bores 136A, 136B. The flow block members 150, 150' block or dam the gaps G at the openings 138A, 138B so that the mastic 170 is retained about the joints 107 (FIG. 10). According to some embodiments, the flow block members 150, 150' provide seals against mastic flow at the interfaces between the flow block members 150, 150' and the connector end faces 140A, 140B. According to some embodiments, the flow block members 150, 150' provide seals against mastic flow at the interfaces between the flow block members 150, 150' and the conductors 32, 62.

In the case of the joint between the connector 130 and the cable 30, the mastic 170 may also be relied upon to prevent or inhibit oil from leaking from the cable 30 (e.g., by sealing the open end of the OBT 110). By preventing or inhibiting displacement of the mastic 170, the connector system 101 (in particular, the flow block member 150') can preserve the integrity of the mastic oil stop seal to retain the oil in the PILC cable 30 even when relatively high oil internal pressures are induced, such as by increases in temperature or placement of the connection at lower elevation than other parts of the cable 30.

Forming the flow block members 150, 150' of silicone rubber may be particularly advantageous for multiple reasons. Silicone rubber is extremely stable across a wide temperature spectrum including the temperature range (from about −40° C. to 250° C.) typically experienced by electrical power transmission connectors. Silicone rubber is highly resistant to attack by and absorption of oil such as the oil contained in the cable 30. Silicone rubber is tear resistant. As discussed above, the resilience of silicone rubber can enable significant cable diameter range taking.

However, according to further embodiments, the flow block members 150, 150' may be formed of other materials. According to some embodiments, the flow block members 150, 150' are formed of a polymeric material, and in some embodiments an elastomeric material, other than silicone rubber. According to some embodiments, the flow block members 150, 150' are formed of nylon. According to some embodiments, the flow block members 150, 150' are formed of PTFE (e.g., Teflon). According to some embodiments, the flow block members 150, 150' are formed of metal (e.g., copper).

According to further embodiments, the flow block members 150, 150' may be formed without insert tabs 156. In particular, the flow block members may be formed by extruding and cutting a tube of the flow block member material into flat rings.

The insert tab 156 of each flow block member 150, 150' can assist the installer in positioning the conductor 62, 32 in the bore 136A, 136B. The insert tab 156 may serve to positively locate the flow block member 150, 150' relative to the connector 130 and the conductor 62, 32. The insert tab 156 can brace or reinforce the body 152 to resist axial deflection that may otherwise permit mastic 170 to flow past the flow block member 150, 150' into the bore 136A, 136B.

Figure 16:
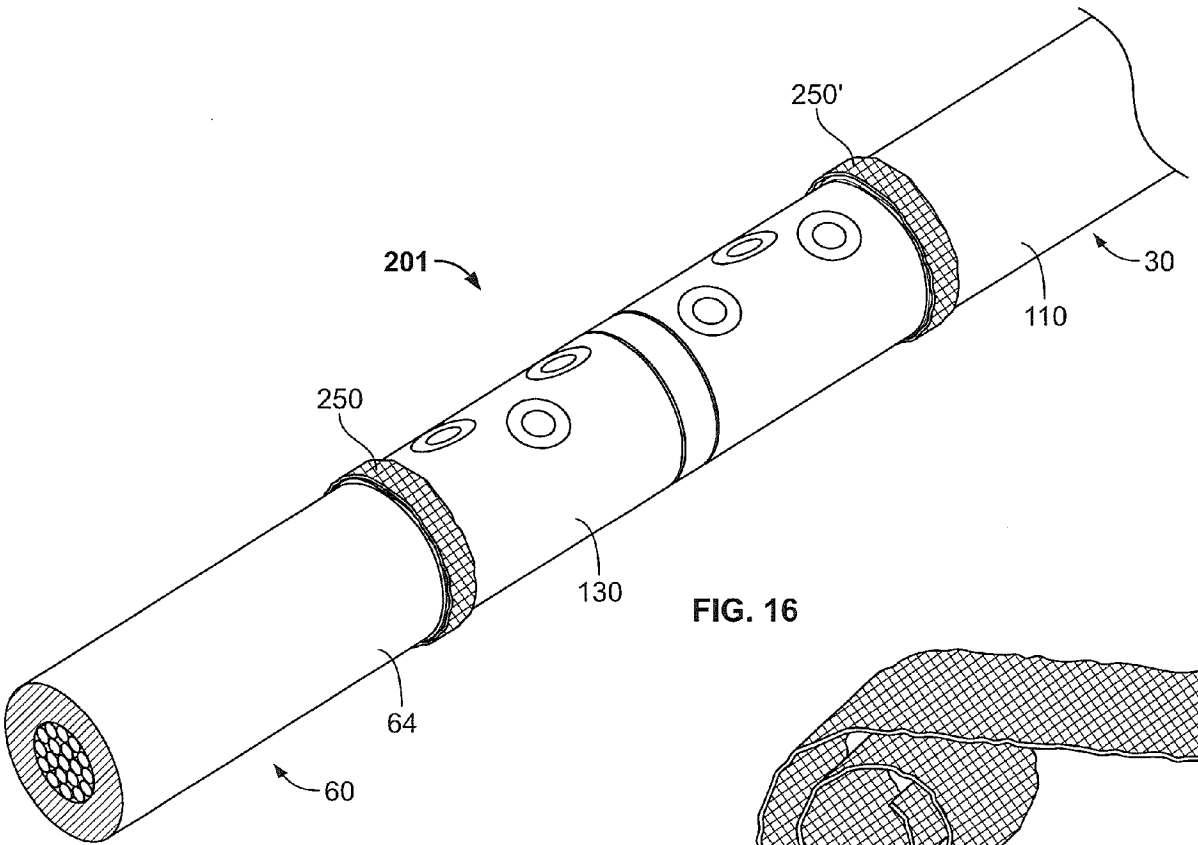
FIG. 16 is a fragmentary perspective view of a connection assembly according to further embodiments of the present invention.
Figure 17:
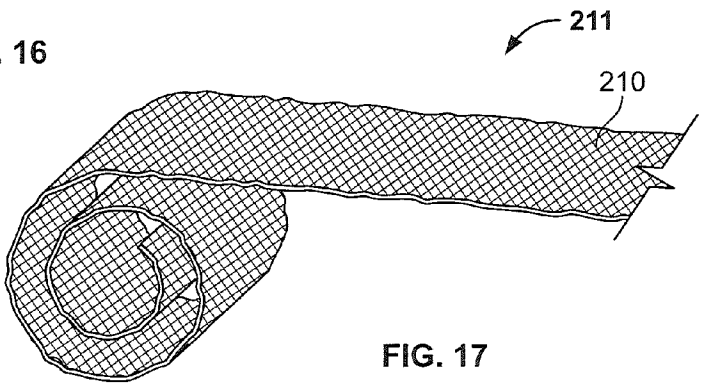
FIG. 17 is a perspective view of a roll of mesh strip used to form the connection assembly of FIG. 16.

With reference to FIGS. 16 and 17, a connector system 201 according to further embodiments of the present invention is shown therein. The connector system 201 can be constructed and assembled in the same manner as the connector system 101 (including incorporation into a cover system corresponding to the cover system 102 to form a protected connection assembly corresponding to the protected connection assembly 104), except as follows.

The connector system 201 includes strips of metal mesh 210, which may be dispensed from a roll 211 (FIG. 17), for example. A first metal mesh strip 210 is wrapped circumferentially about the exposed conductor 62 immediately adjacent the terminal end 64A of the insulation 64 to form a flow block member 250 (FIG. 16). A second metal mesh strip 210 is wrapped circumferentially about the exposed conductor 32 immediately adjacent the terminal end 110B of the OBT 110 to form a flow block member 250'. According to some embodiments, the flow block members 250, 250' are installed on the conductors 62, 32 in this manner prior to inserting the conductors 62, 32 into the connector bores 136A, 136B. The mastic 170 (not shown) is thereafter applied over the connector 130, the flow block members 250, 250', the insulation 64 and the OBT 110 in the same manner as described above. According to some embodiments, the flow block members 250, 250' are wrapped tightly about the conductors 62, 32. The outer diameters of the flow block members 250, 250' are greater than the inner diameter D4 of the connector openings 138A, 138B. According to some embodiments, the mesh strips 210 are formed of copper.

Figure 18:
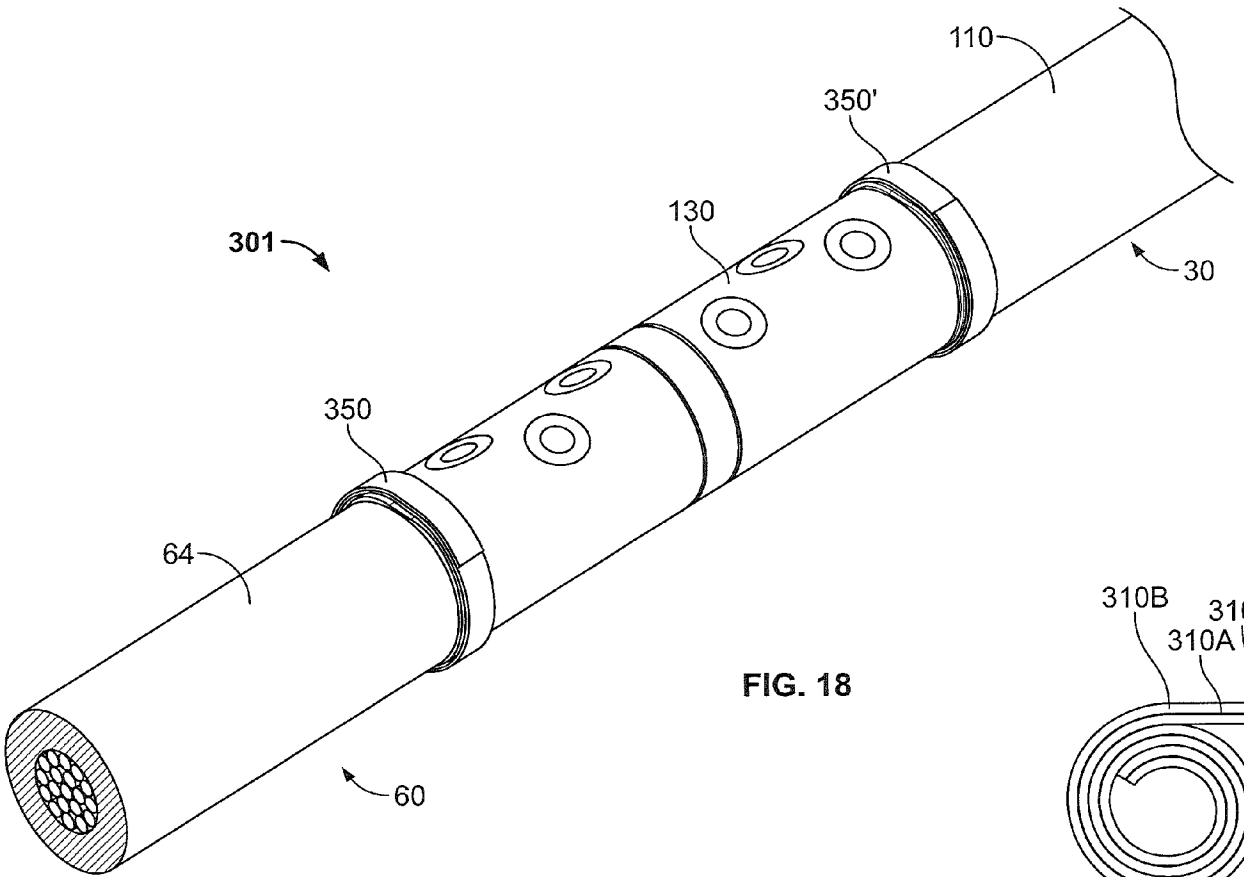
FIG. 18 is a fragmentary perspective view of a connection assembly according to further embodiments of the present invention.
Figure 19:
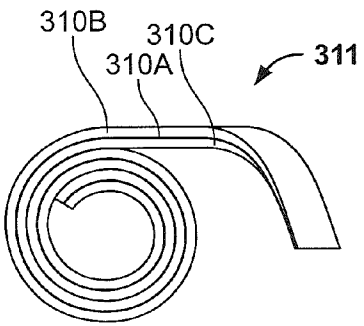
FIG. 19 is a perspective view of a roll of mesh composite tape used to form the connection assembly of FIG. 18.

With reference to FIGS. 18 and 19, a connector system 301 according to further embodiments of the present invention is shown therein. The connector system 301 can be constructed and assembled in the same manner as the connector system 201, except as follows. The connector system 301 includes strips of metal mesh composite tape 310, which may be dispensed from a roll 311, for example (FIG. 19). The mesh composite tape 310 includes a metal mesh layer 310A interposed, sandwiched or laminated between opposed layers of mastic 310B, 310C. The strips 310 are wrapped about the conductors 62, 32 as described above for the strips 210 to form flow block members 350, 350' (FIG. 18). The mastic 170 (not shown) is thereafter applied over the connector 130, the flow block members 350, 350', the insulation 64 and the OBT 110 in the same manner as described above.

Figure 20:
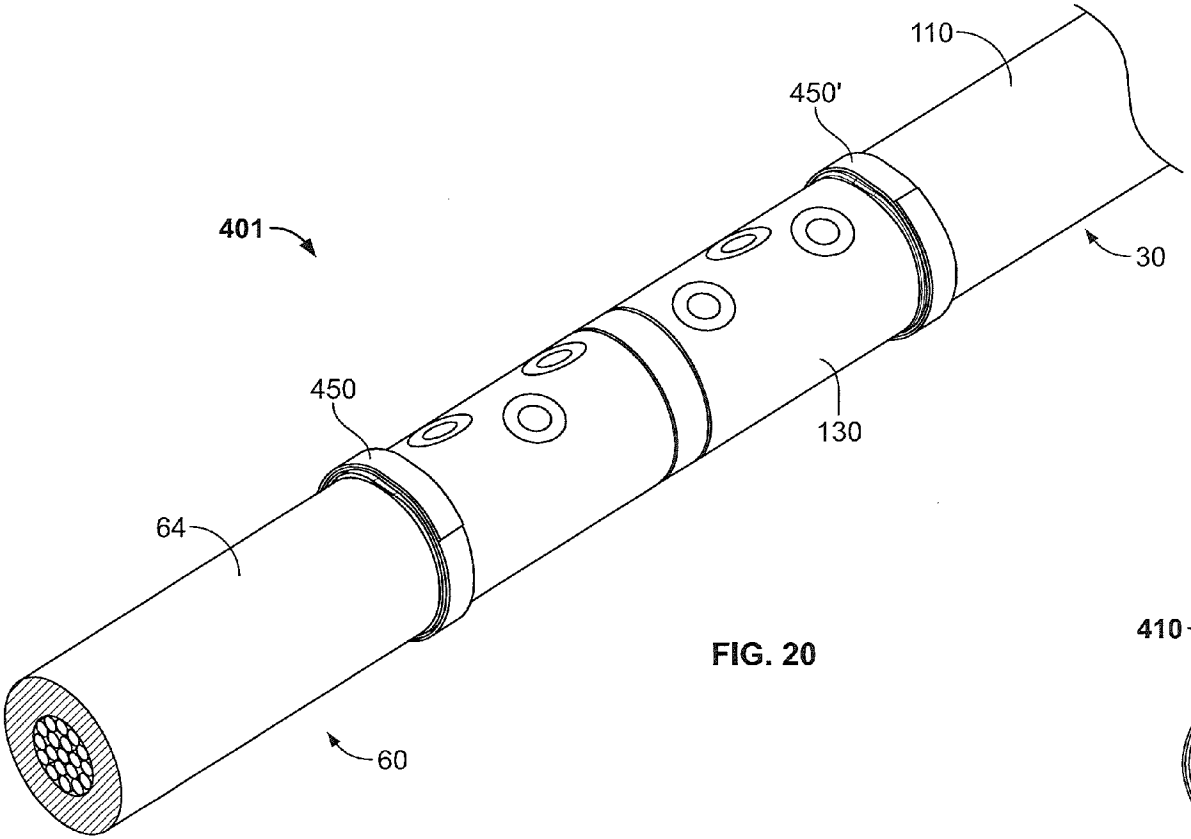
FIG. 20 is a fragmentary perspective view of a connection assembly according to further embodiments of the present invention.
Figure 21:
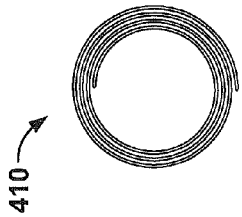
FIG. 21 is a side view of a spring clamp used to form the connection assembly of FIG. 20.

With reference to FIGS. 20 and 21, a connector system 401 according to further embodiments of the present invention is shown therein. The connector system 401 can be constructed and assembled in the same manner as the connector system 101 (including incorporation into a cover system corresponding to the cover system 102 to form a protected connection assembly corresponding to the protected connection assembly 104), except as follows.

The connector system 401 includes a pair of spring clamps 410 (FIG. 21). Each spring clamp 410 includes a strip 414 of a spirally wound resilient metal (e.g., stainless steel). A first spring clamp 410 is mounted about the exposed conductor 62 immediately adjacent the terminal end 64A of the insulation 64 to form a flow block member 450 (FIG. 20). A second spring clamp 410 is mounted about the exposed conductor 32 immediately adjacent the terminal end 110B of the OBT 110 to form a flow block member 450' (FIG. 20). The spring clamps 410 may be mounted on the conductors 62, 32 by uncoiling them from a wound or coiled state and wrapping them about the conductors 62, 32 such that they are permitted to resiliently return to a coiled state. According to some embodiments, the flow block members 450, 450' are installed on the conductors 62, 32 in this manner prior to inserting the conductors 62, 32 into the connector bores 136A, 136B. The mastic 170 (not shown) is thereafter applied over the connector 130, the flow block members 450, 450', the insulation 64 and the OBT 110 in the same manner as described above. According to some embodiments, the flow block members 450, 450' fit tightly about the conductors 62, 32. The outer diameters of the flow block members 450, 450' are greater than the inner diameter D4 (FIG. 13) of the connector openings 138A, 138B.

Figure 22:
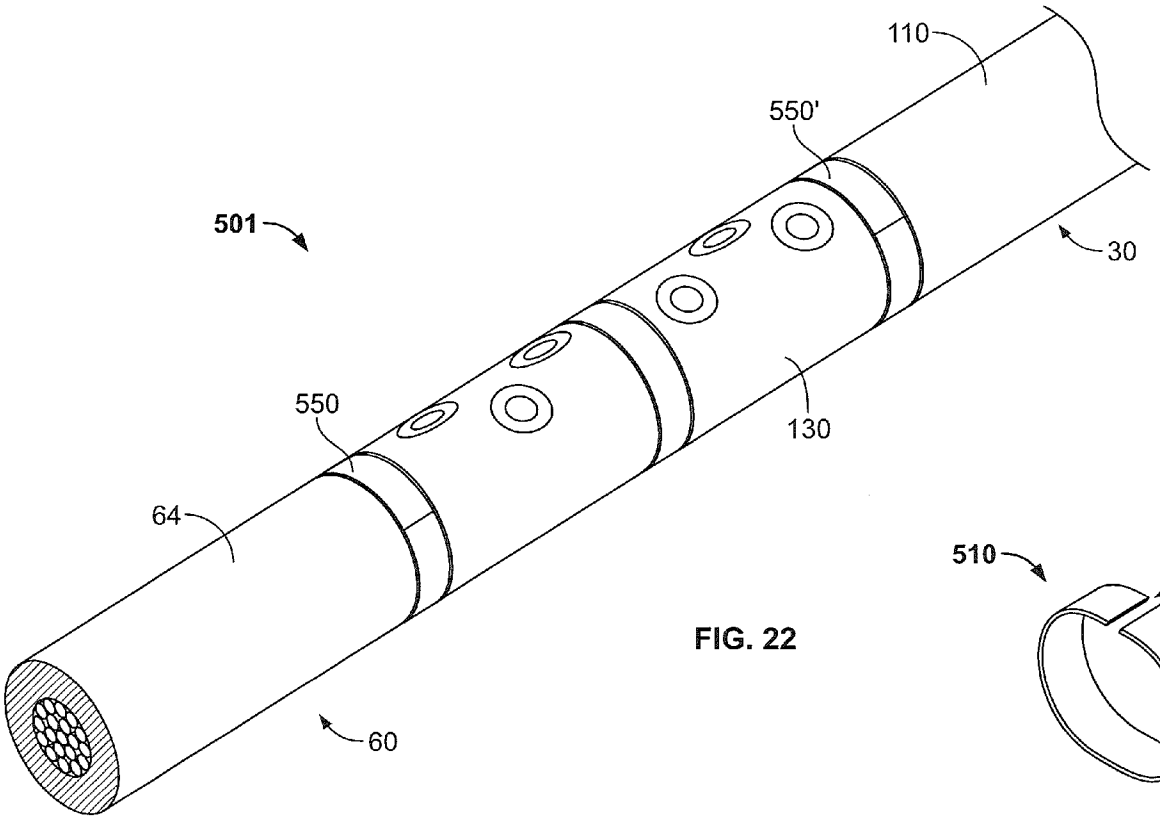
FIG. 22 is a fragmentary perspective view of a connection assembly according to further embodiments of the present invention.
Figure 23:
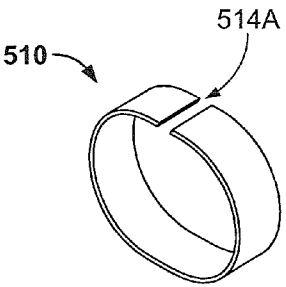
FIG. 23 is a side view of a split ring used to form the connection assembly of FIG. 22.

With reference to FIGS. 22 and 23, a connector system 501 according to further embodiments of the present invention is shown therein. The connector system 501 can be constructed and assembled in the same manner as the connector system 101 (including incorporation into a cover system corresponding to the cover system 102 to form a protected connection assembly corresponding to the protected connection assembly 104), except as follows.

The connector system 501 includes a pair of split rings 510 (FIG. 23). Each split ring 510 includes a C-shaped strip 514 of metal (e.g., copper or aluminum) defining a circumferential gap 514A. A first split ring 510 is mounted about the exposed conductor 62 immediately adjacent the terminal end 64A of the insulation 64 to form a flow block member 550 (FIG. 22). A second split ring 510 is mounted about the exposed conductor 32 immediately adjacent the terminal end 110B of the OBT 110 to form a flow block member 550' (FIG. 22). According to some embodiments, the flow block members 550, 550' are installed on the conductors 62, 32 in this manner prior to inserting the conductors 62, 32 into the connector bores 136A, 136B. The mastic 170 (not shown) is thereafter applied over the connector 130, the flow block members 550, 550', the insulation 64 and the OBT 110 in the same manner as described above. According to some embodiments, the flow block members 550, 550' fit tightly about the conductors 62, 32. According to some embodiments, the split rings 510 are compressed or crushed (e.g., using pliers) about the conductors 62, 32 to close (partially or fully) the gap 514A (FIG. 23). The outer diameters of the flow block members 550, 550' are greater than the inner diameter D4 of the connector openings 138A, 138B.

Figure 24:
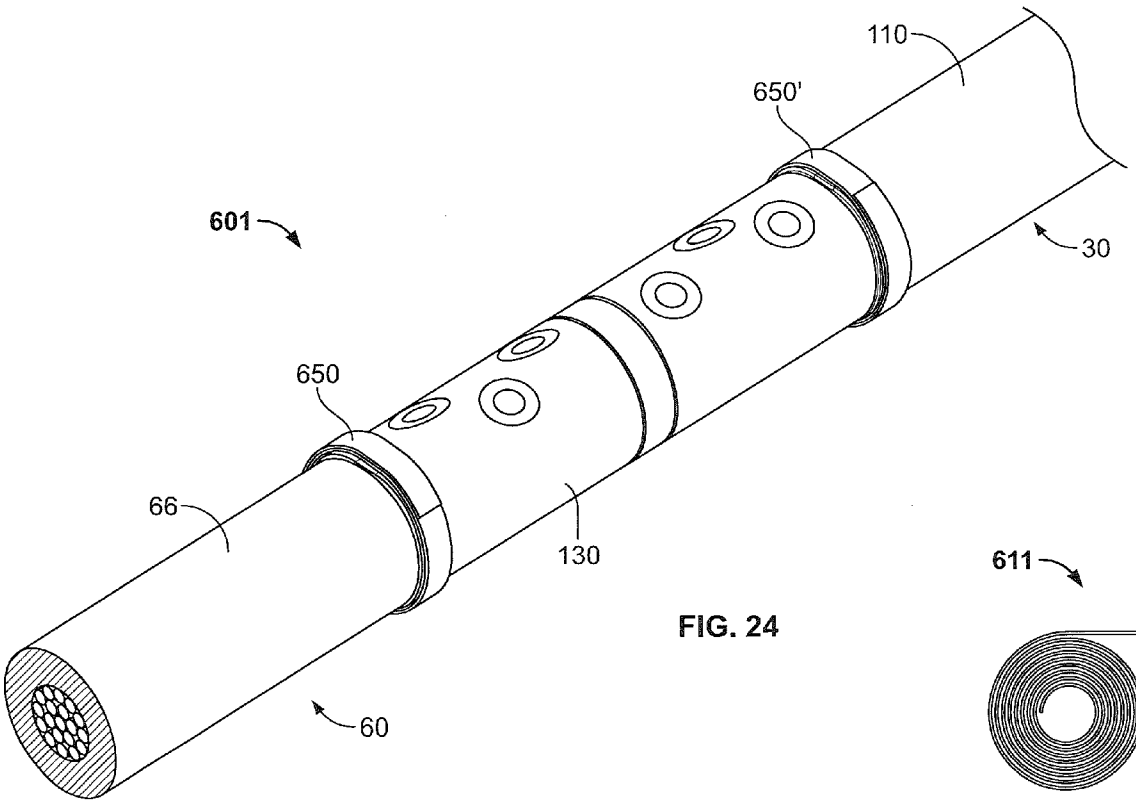
FIG. 24 is a fragmentary perspective view of a connection assembly according to further embodiments of the present invention.
Figure 25:
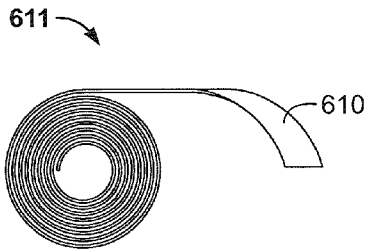
FIG. 25 is a perspective view of a roll of silicone rubber tape used to form the connection assembly of FIG. 24.

With reference to FIGS. 24 and 25, a connector system 601 according to further embodiments of the present invention is shown therein. The connector system 601 can be constructed and assembled in the same manner as the connector system 201, except as follows. The connector system 601 includes strips of silicone rubber tape 610, which may be dispensed from a roll 611, for example (FIG. 25). The strips 610 are wrapped about the conductors 62, 32 as described above for the strips 210 to form flow block members 650, 650' (FIG. 24). The mastic 170 (not shown) is thereafter applied over the connector 130, the flow block members 650, 650', the insulation 64 and the OBT 110 in the same manner as described above.

Figure 26:
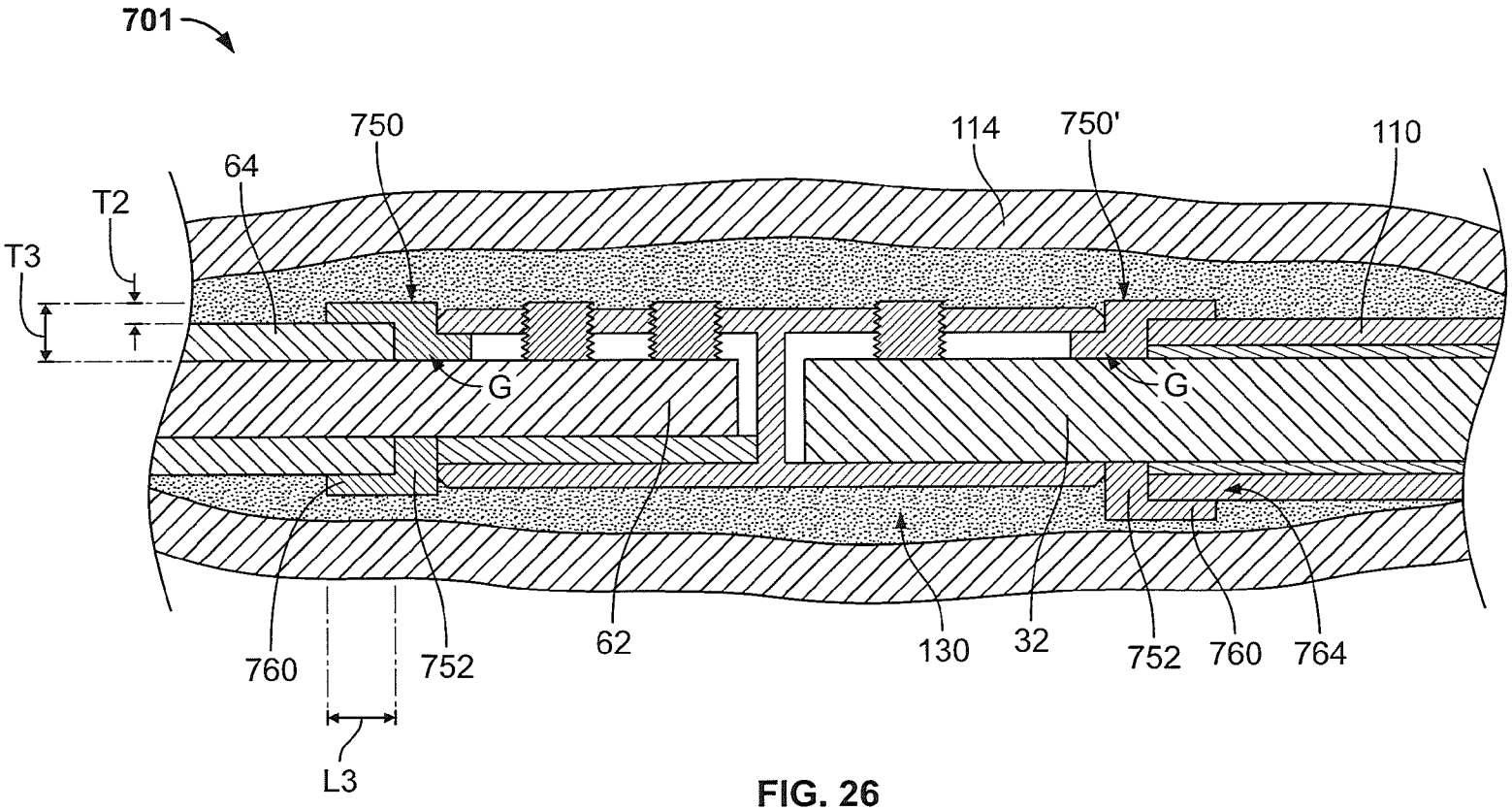
FIG. 26 is a cross-sectional view of a connection assembly according to further embodiments of the present invention.
Figure 27:
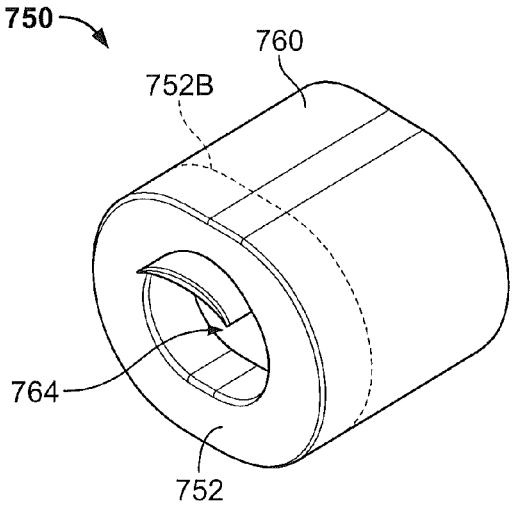
FIG. 27 is a perspective view of a flow block member forming a part of the connection assembly of FIG. 26.

With reference to FIGS. 26 and 27, a connector system 701 according to further embodiments of the present invention is shown therein. The connector system 701 may be constructed and assembled in the same manner as the connector system 101, except as follows. The connector system 701 can be incorporated into a cover system corresponding to the cover system 104 to form a protected connection assembly corresponding to the protected connection assembly 102.

The connector system 701 includes flow block members 750, 750' (FIG. 26) corresponding to the flow block members 150, 150', except that the flow block members 750, 750' are each further provided with an integral, tubular cover portion, extension or flap 760 extending rearwardly beyond the rear face 752B. The cover flap 760 may be formed of the same material as the body 752 and the flow block member 750, 750' may be monolithic. The cover flap 760 is pliable and elastic so that it can be slid, rolled, inverted or compressed into a retracted position and slid, rolled, reverted or extended into an extended position as shown in FIGS. 26 and 27. When extended, the cover flap 760 defines an interior through passage 764.

In use, the flow block members 750, 750' may be installed in the same manner as described above for the flow block members 150, 150', except as follows. The flow block member 750 is slid onto the conductor 62, which is in turn inserted into the bore of the connector 130. At this time, the cover flap 760 may be positioned around the body 752 or an adjacent portion of the connector 130. The cover flap 760 is then pushed, slid, rolled or otherwise extended out over the cable insulation 64 as shown in FIG. 26 such that the cover flap 760 circumferentially surrounds a portion of the insulation 64 and the joint between the insulation 64 and the flow block member 750.

According to some embodiments, the relaxed inner diameter of the resilient cover flap 760 is less than the outer diameter of the insulation 64 so that the cover flap 760 is elastically expanded and exerts a persistent radially compressive load on the insulation 64.

The flow block member 750' and its cover flap 760 may be installed on the cable 30 in the same manner such that the cover flap 760 overlaps the OBT 110 as shown in FIG. 26. The mastic 170, the stress control tube 114, and other components may thereafter be installed as previously described.

According to some embodiments, a supplemental layer of mastic may be applied to (e.g., wrapped around) the insulation 64 and/or the OBT 110 adjacent the associated flow block member 750, 750' prior to extending the cover flap 760 thereof. The cover flap 760 is then extended so that the deployed cover flap 760 surrounds the supplemental mastic layer (which is interposed between the cover flap 760 and the insulation 64 or OBT 110).

The cover flaps 760 can serve to secure the flow block members 750, 750' on the cables 60, 30. The cover flaps 760 can also serve to prevent or inhibit the flow of the mastic into the gap between the insulation 64 and the block member 750, or into the gap between the OBT 110 and the flow block member 750', and through the through passages 754 around the conductors 62, 32.

With reference to FIG. 26, according to some embodiments as shown, the outer diameter of the cover flap 760 is substantially the same as the outer diameter of the associated body 752, but the thickness T2 of the outer flap 760 is between about 20 and 40 percent of the thickness T3 of the body 752. According to some embodiments, the thickness T2 is in the range of from about 0.25 inch to 0.38 inch. According to some embodiments, the length L3 of the cover flap 760 is in the range of from about 0.5 inch to 1.0 inch.

Figure 28:
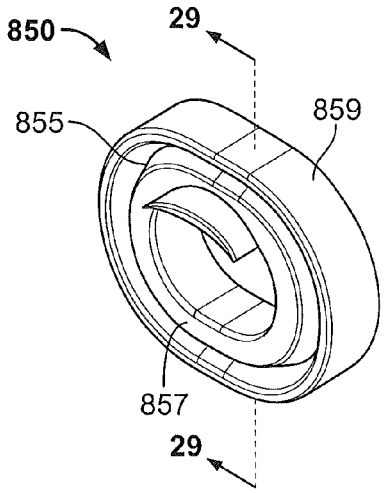
FIG. 28 is a perspective view of a flow block member according to further embodiments of the present invention.
Figure 29:
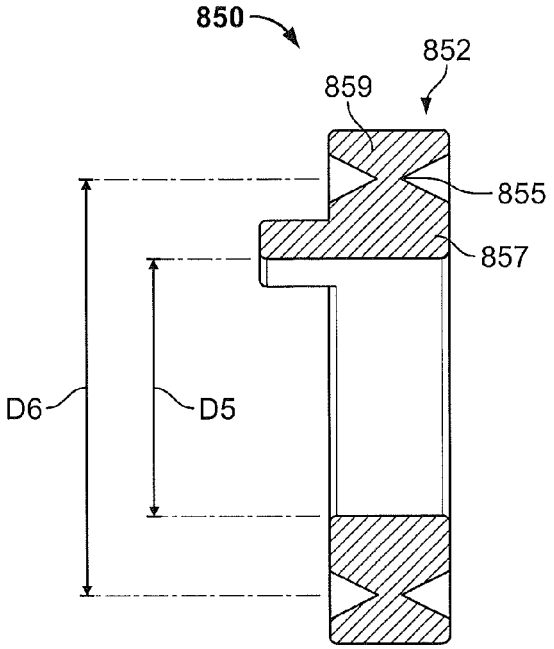
FIG. 29 is a cross-sectional view of the flow block member of FIG. 28 taken along the line 29-29 of FIG. 28.

With reference to FIGS. 28 and 29, a flow block member 850 according to further embodiments of the present invention is shown therein. The flow block member 850 can be used in place of any of the flow block members described herein as part of a cable connector system to form a connection assembly. The flow block member 850 corresponds to the flow block member 150 except that the flow block member 850 includes an annular defined cut, tear, weakness or separation line 855. The separation line 855 divides the integral body 852 into an annular inner subbody 857 and an annular outer subbody 859. The subbodies 857, 859 are joined at the separation line 855 and may be collectively monolithic.

The inner and outer subbodies 857, 859 can be selectively separated at the separation line 855. According to some embodiments, the body 852 is frangible at the separation line 855 and the subbodies 857, 859 are separated by tearing along the separation line 855. According to some embodiments, the body 852 is cut (e.g., using a knife blade) along the separation line 855 to separate the subbodies 857, 859.

The inner subbody 857 defines an inner passage 857A for the cable conductor 32, 62 having a first diameter D5. When the subbody 857 is removed, the outer subbody 859 defines a passage 859A for the conductor 32, 62 having a diameter D6. It will be appreciated that the diameter D6 is greater than the diameter D5.

In use, for a conductor 32, 62 having an outer diameter in a first range, the flow block member 850 is mounted thereon with the inner subbody 857 in place within the outer subbody 859. However, for a conductor 32, 62 having an outer diameter in a second range greater than the first range, the inner subbody 857 is removed and the outer subbody 859 is mounted on the conductor 32, 62. Accordingly, the flow block member 850 can be properly fitted to a greater range of cable sizes.

In some embodiments, the connector 130 may be provided without an oil block wall 134, in which case the two conductor bores 136A, 136B may form parts of a bore that passes fully through the connector body 132.

Connector systems according to embodiments of the invention may be used for any suitable cables and connections. Such connector systems may be adapted for use, for example, with connections of medium voltage cables (i.e., between about 8 kV and 46 kV).

While the connections to PILCs have been described herein with reference to PILC-to-polymeric cable transition splices, connector systems as disclosed herein may also be used in PILC-to-PILC splices and polymeric cable-to-polymeric cable splices. Connector systems according to embodiments of the invention may also be configured for non-splice cable terminations and elbows, for example, for PILC cables and polymeric cables.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A cable connector system comprising:

an electrical cable including a primary conductor and an insulation layer surrounding the primary conductor, wherein the insulation layer has an insulation terminal end and the primary conductor extends beyond the insulation terminal end;

a connector defining a conductor bore, an entry opening communicating with the conductor bore, and a connector end face surrounding the entry opening;

a flow block member defining a passage extending therethrough; and a flowable sealant;

wherein:

the primary conductor extends through the passage and the entry opening and into the conductor bore, the primary conductor being mechanically and electrically coupled to the connector;

the flow block member is thereby mounted on the primary conductor and interposed between the insulation terminal end and the connector end face;

the sealant surrounds the flow block member and adjacent portions of the insulation layer and the connector; and the flow block member inhibits flow of the sealant into the conductor bore through the entry opening.

2. The connector system of claim 1 wherein the sealant is a mastic.

3. The connector system of claim 1 wherein:

the flow block member includes an annular body having opposed front and rear faces and defining the passage;

the front face directly engages the connector end face; and the rear face directly engages the insulation terminal end.

4. The connector system of claim 1 wherein:

the flow block member includes an annular body having opposed front and rear faces and defining the passage; and the annular body is formed of a resilient polymeric material.

5. The connector system of claim 4 wherein the annular body is formed of silicone rubber.

6. The connector system of claim 5 wherein the annular body forms a resilient seal at an interface between the front face of the flow block member and the connector end face.

7. The connector system of claim 3 wherein the annular body is formed of a closed cell polymeric foam.

8. The connector system of claim 1 wherein:

the flow block member includes an integral insert tab; and the insert tab is disposed in the conductor bore radially between the primary conductor and a sidewall of the connector.

9. The connector system of claim 1 wherein the connector includes a bolt extending radially into the conductor bore and clamping the primary conductor in the conductor bore.

10. The connector system of claim 9 wherein the connector is a shearbolt connector and the bolt is a shearbolt.

11. The connector system of claim 9 including a spacer insert disposed in the conductor bore radially between the primary conductor and a sidewall of the connector and on a side of the primary conductor substantially radially opposite the bolt.

12. The connector system of claim 1 wherein:

the connector further defines a second conductor bore, a second entry opening communicating with the second conductor bore, and a second connector end face surrounding the second entry opening; and the connector system further includes:

a second electrical cable including a second primary conductor and a second insulation layer surrounding the second primary conductor, wherein the second insulation layer has a second insulation terminal end and the second primary conductor extends beyond the second insulation terminal end; and a second flow block member defining a second passage extending therethrough;

wherein:

the second primary conductor extends through the second passage and the second entry opening and into the second conductor bore, the second primary conductor being mechanically and electrically coupled to the connector;

the second flow block member is thereby mounted on the second primary conductor and interposed between the second insulation terminal end and the second connector end face;

the sealant surrounds the second flow block member and adjacent portions of the second insulation layer and the connector; and the second flow block member inhibits flow of the sealant into the second conductor bore through the second entry opening.

13. The connector system of claim 1 wherein:

the insulation layer is formed of a polymeric material; and the cable is a polymeric electrical power transmission cable including a semiconductive layer surrounding the insulative layer, a jacket surrounding the semiconductive layer, and a neutral conductor between the semiconductive layer and the jacket.

14. The connector system of claim 1 wherein:

the cable is a paper oil-impregnated lead electrical power transmission cable including an oil-impregnated paper insulation layer surrounding the primary conductor and a metal sheath surrounding the oil-impregnated paper insulation layer; and the insulation layer includes an oil barrier tube surrounding the oil-impregnated paper insulation layer.

15. The connector system of claim 1 including an electrical stress relief tube surrounding the connector, the flow block member and the sealant, wherein the electrical stress relief tube applies a radially compressive load to the sealant tending to force at least a portion of the sealant toward the entry opening.

16. The connector system of claim 1 wherein the flow block member includes a metal mesh strip circumferentially wound about the primary conductor between the insulation terminal end and the connector end face.

17. The connector system of claim 1 wherein the flow block member includes a metal mesh composite strip circumferentially wound about the primary conductor between the insulation terminal end and the connector end face, the metal mesh composite strip including a metal mesh layer and at least one layer of the sealant.

18. The connector system of claim 1 wherein the flow block member includes a spring clamp mounted on the primary conductor between the insulation terminal end and the connector end face.

19. The connector system of claim 1 wherein the flow block member includes a split ring mounted on the primary conductor between the insulation terminal end and the connector end face.

20. The connector system of claim 1 wherein the flow block member includes an annular body and a tubular cover flap extending axially from the body and surrounding a portion of the insulation layer.

21. The connector system of claim 1 wherein the flow block member includes an integral body comprising an annular inner subbody and an annular outer subbody surrounding the inner subbody and separably joined thereto at a separation line.

22. A method for forming a protected electrical connection assembly, the method comprising:

providing an electrical cable including a primary conductor and an insulation layer surrounding the primary conductor, wherein the insulation layer has an insulation terminal end and the primary conductor extends beyond the insulation terminal end;

providing a connector defining a conductor bore, an entry opening communicating with the conductor bore, and a connector end face surrounding the entry opening;

providing a flow block member defining a passage extending therethrough;

inserting the primary conductor through the passage and the entry opening and into the conductor bore such that the flow block member is thereby mounted on the primary conductor and interposed between the insulation terminal end and the connector end face;

mechanically and electrically coupling the primary conductor to the connector; and applying a sealant to surround the flow block member and adjacent portions of the insulation layer and the connector, wherein the flow block member inhibits flow of the sealant into the conductor bore through the entry opening.

23. A cable connector system kit for use with an electrical cable including a primary conductor and an insulation layer surrounding the primary conductor, wherein the insulation layer has an insulation terminal end and the primary conductor extends beyond the insulation terminal end, the kit comprising:

a connector defining a conductor bore, an entry opening communicating with the conductor bore, and a connector end face surrounding the entry opening, wherein the connector is adapted to mechanically and electrically couple with the primary conductor;

a flow block member defining a passage extending therethrough and adapted to receive the primary conductor; and a flowable sealant to apply about the connector and the insulation layer;

wherein the connector and the flow block member are relatively configured and constructed to be assembled into a connector system wherein:

the primary conductor extends through the passage and the entry opening and into the conductor bore, the primary conductor being mechanically and electrically coupled to the connector;

the flow block member is thereby mounted on the primary conductor and interposed between the insulation terminal end and the connector end face;

the sealant surrounds the flow block member and adjacent portions of the insulation layer and the connector; and the flow block member inhibits flow of the sealant into the conductor bore through the entry opening.

* * * * *